US006508696B1

(12) United States Patent
Kobayashi et al.

(10) Patent No.: US 6,508,696 B1
(45) Date of Patent: Jan. 21, 2003

(54) WAFER-POLISHING HEAD AND POLISHING APPARATUS HAVING THE SAME

(75) Inventors: Tatsunori Kobayashi, Omiya (JP); Hiroshi Tanaka, Omiya (JP); Jiro Kajiwara, Cupertino, CA (US)

(73) Assignees: Mitsubishi Materials Corporation, Tokyo (JP); Multi Planar Technologies, Inc., San Jose, CA (US)

( * ) Notice: Subject to any disclaimer, the term of this patent is extended or adjusted under 35 U.S.C. 154(b) by 40 days.

(21) Appl. No.: 09/645,938

(22) Filed: Aug. 25, 2000

(51) Int. Cl.[7] ..... B24B 29/00

(52) U.S. Cl. ..... 451/288; 451/286; 451/289; 451/29

(58) Field of Search ..... 451/288, 290, 451/289, 286, 398, 397, 285, 41

(56) References Cited

U.S. PATENT DOCUMENTS 5,913,718 A * 6/1999 Shendon ..... 451/288

6,210,255 B1 * 4/2001 Zuniga et al. ..... 451/41

* cited by examiner

*Primary Examiner*—Timothy V. Eley
*Assistant Examiner*—Alvin J Grant
(74) *Attorney, Agent, or Firm*—Oblon, Spivak, McClelland, Maier & Neustadt, P.C.

(57) ABSTRACT

A wafer-polishing head which has an increased flexible membrane life and improved wafer polishing accuracy has a principal head 106 having a lower opening portion 106*a* with an approximately circular shape. A flexible membrane 2 which is positioned in the opening portion 106*a* of the principal heal head 106 for closing the opening portion 106*a* and for holding a wafer W at the underside of an inward peripheral portion 2*a* of the flexible membrane. A sealed pressurizing chamber 107 is formed by closing the opening portion 106*a* with the flexible membrane. A pressure regulator is provided for controlling the internal pressure of the pressurizing chamber 107. The flexible membrane 2 is thicker in an outer peripheral portion 2*b* thereof than in the inward peripheral portion 2*a* which holds the wafer.

8 Claims, 5 Drawing Sheets

WAFER-POLISHING HEAD AND POLISHING APPARATUS HAVING THE SAME

BACKGROUND OF THE INVENTION

1. Field of the Invention

The present invention relates to a wafer-polishing head which is used in an apparatus for polishing the surface of wafers such as a semiconductor wafer or the like, and a polishing apparatus having the same.

2. Description of the Related Art

Recently, fineness of patterning of wafers has become important, in accordance with high level of integration thereof. It has become especially important to flatten semiconductor wafers where the patterning is formed and to flatten the surface of semiconductor wafers as much as possible in the process of forming the patterning, such that the formation of a fine pattern having a multi-layer structure can be carried out easily and surely. For example, the formation of a pattern is carried out using optical lithography, and the depth of focus in the optical lithography becomes shallow in proportion to the fineness of a pattern. In order to increase the accuracy of a pattern and to easily control focus during exposure, it is required that a difference of unevenness on a wafer surface is no greater than the depth of focus (that is, flatness).

Further, with regard to polishing bare wafers, a requirement for flatness has become severe in proportion to the increased size of the wafer. In this case, a chemical and mechanical polishing method (CPM method) is known which provides a high flatness to the polished surface of semiconductor wafers (referred to as a wafer, hereunder). In the CMP method, the surface of the wafer is polished chemically and mechanically to obtain a flatness of the surface using an alkaline slurry containing $SiO_2$, a neutral slurry containing $CeO_2$, an acid slurry containing $Al_2O_3$ or a slurry containing abrasive grains (hereunder, these slurries are generally referred to as abrasive grain-containing slurries). For example, a polishing apparatus shown in FIG. 4 is known for polishing the surface of wafers according to the CPM method.

As schematically shown in FIG. 4, which is an enlarged perspective view of an important part of the CPM, a polishing pad 104 comprising, for example, hard urethane, is provided on a disc-shaped platen 103 attached to a center shaft 102 in a polishing apparatus 100, and a wafer-polishing head 105 which holds a wafer W is disposed facing the polishing pad 104 and in a position eccentric to the center shaft 102 of the polishing pad 104 such that the polishing head can be rotated on its own axis. In the polishing apparatus 100, the polishing pad 104 and the wafer W are moved relatively to each other while the wafer W is pressed against the surface of the polishing pad 104 by the wafer-polishing head 105. The above-mentioned abrasive grain-containing slurry S is interposed between the wafer W and the polishing pad 104, thereby to polish one surface of the wafer W. The polishing apparatus 100 as shown in FIG. 4 is only one example. There are known polishing apparatuses having a plurality of wafer-polishing heads 105.

Next, one example of wafer-polishing pad 105 is schematically shown in front sectional view in FIG. 5(*a*). The wafer-polishing head 105*a* shown in FIG. 5(*a*) comprises a principal head 106 having a lower opening portion 106*a* and having an approximately circular shape. A flexible membrane 108 is positioned inside the principal head 106 for closing the opening portion 106*a* and for holding a wafer W at the underside of an inward peripheral portion 108*a*. A sealed pressurizing chamber 107 is formed by closing the opening portion 106*a* with the flexible membrane 108. A pressure regulator 109 is connected to the pressurizing chamber 107 to control the internal pressure thereof.

The flexible membrane 108 comprises a flexible film and is fixed to the principal head 106 so as to be approximately planar over the full face thereof, for example by putting the outer peripheral portion of the flexible membrane between the principal head 106 and a guide ring 110 which has an approximately annular shape and is attached to the end of the opening portion of the principal head 106, as shown in FIG. 5(*b*) which is a partially enlarged view of FIG. 5(*a*).

The pressure regulator is used for adjusting a force for displacing the flexible membrane 108 in the axial direction of the head by controlling the internal pressure of the pressurizing chamber 107. In the wafer-polishing head 105*a*, a force for displacing the flexible membrane 108 in the axial direction of the head, that is a force by which the flexible membrane 108 presses a wafer W against a polishing pad 104 (polishing pressure), is adjusted such that the polishing pressure for the wafer W is controlled within a proper range thereof.

A guide ring 110 is attached to the principal head 106, surrounding the end of the opening portion of the principal head. When the wafer W is polished, the guide ring protects the wafer W from dropping out from the wafer-polishing head 105*a* while it is pressed against the polishing pad 104, and decreases the deformation of the polishing pad 104 by pressing the polishing pad in a portion surrounding the wafer W, with the result that the working accuracy at the outer peripheral edge of the wafer W is increased.

A wafer-polishing head having a structure mentioned above is disclosed in JP-A 5-69310, for example.

Other wafer-polishing heads are also known. FIG. 6(*a*) is a front sectional view schematically illustrating a wafer-polishing head 105*b* and FIG. 6(*b*) is a partially enlarged view of FIG. 6(*a*). The wafer-polishing head 105*b* of these figures comprises a principal head 111 having a lower opening portion 111*a* and having an approximately circular shape; a holding member 112 is disposed inside of the principal head 111; a flexible membrane 114 having an outer peripheral portion 114*b* is held by the holding member 112 so that the outer peripheral portion 114*b* of the membrane is turned up and inward toward the peripheral portion 114*a*; and a pressurizing chamber 113 is formed inside the opening portion 111*a* by the flexible membrane 114. Here, a pressure regulator 115 is connected to the pressurizing chamber 113 to control the internal pressure thereof. Further, in this example a retaining ring 116 having an approximately annular shape is provided in the lower end of the wafer-polishing head 105*b*, surrounding the periphery of the opening portion 111*a*. The flexible membrane comprises a flexible film and holds a wafer W underneath the lower surface thereof. In the same manner as in the wafer-polishing head 105*a*, a force by which the flexible membrane 114 presses the wafer W against a polishing pad 104 (polishing pressure) is adjusted by controlling the internal pressure of the pressurizing chamber 113 with the pressure regulator 115. The retaining ring 116 has almost the same function as the guide ring 110 of the wafer-polishing head 105*a*.

A wafer-polishing head having the structure mentioned above is disclosed in JP-A 10-337658, for example.

The above-mentioned wafer-polishing heads 105*a* and 105*b* apply polishing pressure to the wafer W by transferring the internal pressure of the pressurizing chamber to the wafer W thorough the flexible membrane, and so the membrane is required to be as thin as possible so that the elasticity of the flexible membrane has no influence on the polishing pressure to the wafer W.

However, as the flexible membrane is apt to deform due to its thinness, it can enter a gap formed between the peripheral end of the wafer W and the inward peripheral portion of the guide ring 110 (or the inward peripheral portion of the retaining ring 116) when the wafer W is pressed against the polishing pad by the internal pressure of the pressurizing chamber. See FIGS. 7(*a*) and 7(*b*). In this case, as the underside of the membrane is not pressed against other members such as the wafer W and the guide ring 110 (or the retaining ring 116), and since the membrane receives the internal pressure of the pressurizing chamber, the deformed part is subject to a heavy load as compared with the other parts. In addition, the deformed part is interposed between the wafer W and the guide ring 110 (or the retaining ring 116), with the result that it can suffer damage. The deformation of the flexible membrane reduces its useful life.

Further, as shown in FIG. 7(*b*), in the wafer-polishing head 105*b*, the outer peripheral portion 114*b* of the flexible membrane 114 is held by the holding member 112 such that the outer peripheral portion 114*b* of the membrane is turned up and in the inward direction. As a result, when the internal pressure of the pressurizing chamber 113 is applied to the inward peripheral portion 114*a* of the flexible membrane 114, the turned up part of the membrane is stretched and is subject to a heavy load as compared with the other parts. In addition, as the turned up part is pressed against a corner where the outer peripheral face and the under surface of the holding member 112 meet, a heavier load concentrates on the turned up part.

Furthermore, the following phenomenon is found in both of the wafer-polishing heads 105*a* and 105*b*. The case of the wafer-polishing head 105*a* is described hereunder, referring to FIG. 7(*a*). The outer peripheral edge of the wafer W is usually beveled. As a result, when the wafer W is pressed against the polishing pad by increasing the internal pressure of the pressurizing chamber, the flexible membrane 108 goes around the beveled outer peripheral edge and a surface area where the wafer W contacts the flexible membrane 108 is larger than that where the wafer contacts the polishing pad 104. The difference between two areas is shown at d in FIG. 7(*a*).

Therefore, a magnitude of the pressure on the polishing pad 104 (polishing pressure) is greater in the outer peripheral edge of the wafer W than in the other parts thereof. As a result, more material is removed in the outer peripheral edge of the wafer W than in the other parts thereof, which has made it difficult to attain a high polishing accuracy of the wafer W (a uniform amount of polishing of wafer). In FIG. 7(*a*), a direction of the force applied to the wafer W and flexible membrane 108 is indicated by arrows, and a magnitude of the corresponding force is indicated by the length of the arrows.

Still farther, in case of polishing a wafer using the above-mentioned wafer-polishing heads, because it is more difficult for the abrasive grain-containing slurry to enter the inward peripheral portion of the wafer W than the outer peripheral portion thereof, an amount of polishing is generally apt to be greater in the outer peripheral portion than in the inward peripheral portion. Therefore, it is required to restrain an amount of polishing of the outward peripheral portion of the wafer.

SUMMARY OF THE INVENTION

The present invention has been made, considering the above-mentioned situation. An object of the present invention is to provide a wafer-polishing head which permits a longer life of the polishing apparatus, and a greater polishing accuracy for wafer.

According to a first aspect of the present invention, the above and other objects are addressed by a wafer-polishing head which polishes a wafer while the wafer is pressed against the surface of a polishing pad attached on a platen and is moved relatively to the polishing pad. The wafer-polishing head comprises a principal head having an opening portion in the lower portion and having an approximately circular shape; a flexible membrane having an approximately circular shape which closes the opening portion and holds the wafer at an inward peripheral portion thereof, a pressurizing chamber formed by the flexible membrane; wherein the flexible membrane is thicker in the outer peripheral portion thereof than in the inward peripheral portion which holds the wafer.

In the wafer-polishing head having a construction mentioned above, as the flexible membrane is thicker in the outer peripheral portion than in the inward peripheral portion which holds the wafer, adequate strength can be ensured in the outer peripheral portion which is susceptible to a load, while restricting to a low value an elastic force in the portion of the flexible membrane which holds the wafer.

Further, as the thickness of the outer peripheral portion is greater, the flexible membrane is hard to deform in the vicinity of the outer peripheral edge of the wafer.

The present invention is applicable to a flexible membrane which is positioned in the opening portion of a principal head with the outer peripheral portion of the membrane turned up and inward, as well as a flexible membrane which is approximately planar throughout.

According to a second aspect of the present invention, the above and other objects are addressed by a wafer-polishing head wherein a thickness of said flexible membrane tapers in such a manner that a portion of the membrane which holds the vicinity of the outer peripheral edge of the wafer is thicker in an outward direction.

In the wafer-polishing head having a construction mentioned above, since a portion of the membrane which holds the outer peripheral edge of the wafer is tapered to be thicker at the outer peripheral side, the thicker portion is harder to deform. Thereby, in the portion which holds the outer peripheral edge of the wafer, a force by which the wafer is pressed against a polishing pad is decreased towards the outer peripheral side when the internal pressure of a pressurizing chamber is raised, with the result that an amount of polishing the wafer changes gently in the corresponding portion.

Further, since a change of thickness is gentle in the boundary between the thin inward peripheral portion and the thicker outer peripheral portion, a load will not concentrate at one portion when a pressure is applied to the flexible membrane from the pressurizing chamber.

According to a third aspect of the present invention, the above and other objects are addressed by a wafer-polishing head, wherein the flexible membrane is positioned in the opening portion of the principal head with the outer peripheral portion of the flexible membrane turned up and inward, and the outer peripheral portion of the flexible membrane is disposed above the inward peripheral portion thereof, where said outer peripheral portion of the flexible membrane comprises at least a portion facing the outer peripheral edge of the wafer and another portion disposed outward from the portion facing the outer peripheral edge of the wafer.

In the wafer-polishing head having a construction mentioned above, as the flexible membrane is positioned in the opening portion of the principal head with a portion of the flexible membrane facing the outer peripheral edge of the wafer and another portion of the flexible membrane disposed outward of the portion facing the outer peripheral edge of the wafer (the two portions are together designated as the outer peripheral portion), and the outer peripheral portion of the flexible membrane is disposed above the inward peripheral portion thereof, the flexible membrane is pressed against a portion of the wafer which is limited to a range within the inward peripheral side of the wafer from the outer peripheral edge of the wafer. Thereby, the contacting area of the wafer and the flexible membrane is smaller than that of the wafer and the polishing pad, with the result that a force by which the wafer is pressed against the polishing pad (polishing pressure) in the outer peripheral edge of the wafer is restrained.

According to a fourth aspect of the present invention, the above and other objects are addressed by a polishing apparatus for polishing a wafer comprising a platen having a polishing pad attached thereon; a wafer-polishing head which holds one face of the wafer to be polished while another face of the wafer is pressed against the polishing pad; wherein polishing of the wafer is carried out by providing relative movement of the platen and the wafer while the wafer is pressed against the polishing pad.

In the polishing apparatus having a construction mentioned above, wafers can be polished by using functions and effects provided by the wafer-polishing head according to any one of the first to third aspects of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

First Embodiment

A wafer-polishing head in the first embodiment of the present invention and a polishing apparatus having the same are described in detail hereunder, referring to drawings.

Figure 1:
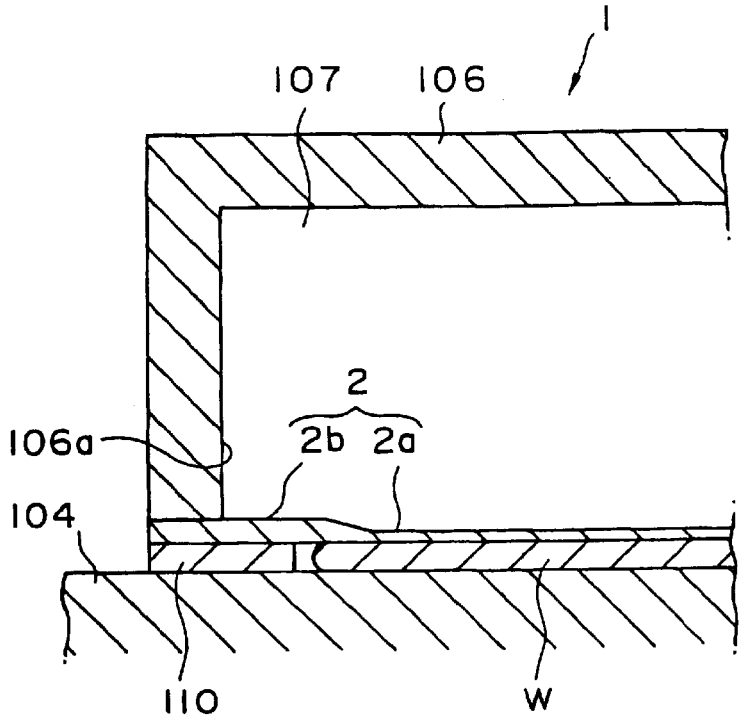
FIG. 1 is a partially enlarged front sectional view illustrating a wafer-polishing head in the first embodiment of the present invention.
Figure 4:
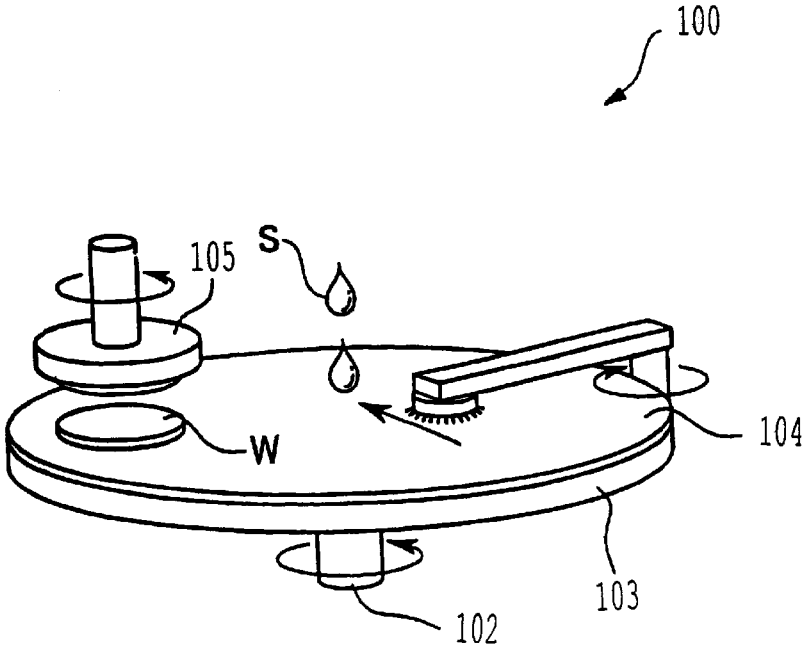
FIG. 4 is an enlarged perspective view of an important part, schematically illustrating a construction of a conventional polishing apparatus.
Figure 5A:
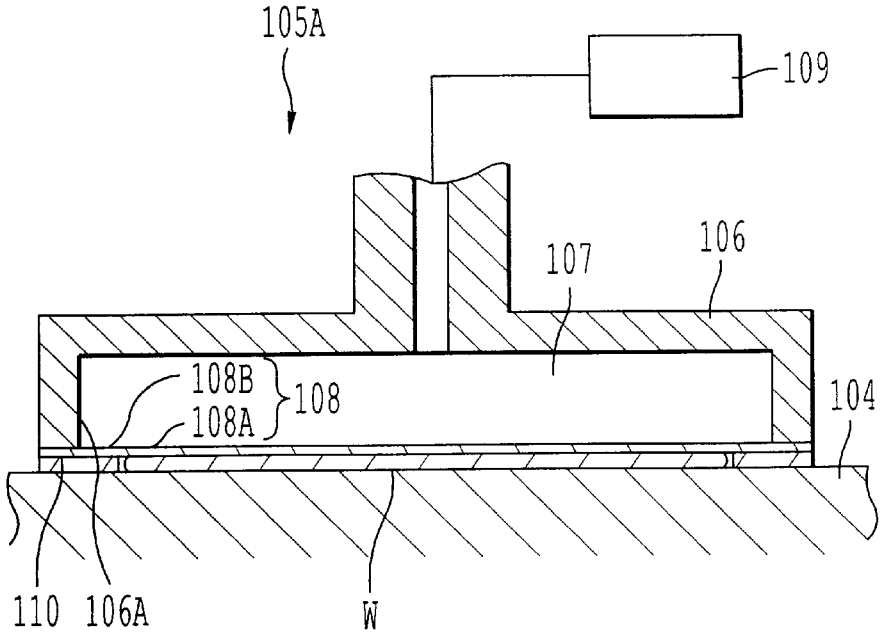
FIG. 5 is a front sectional view showing an example of a conventional wafer-polishing head.
Figure 5B:
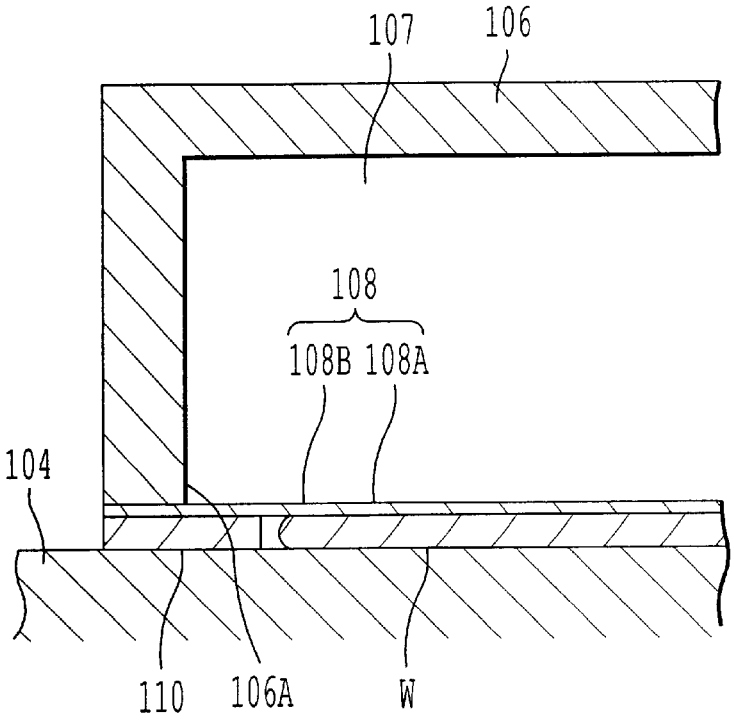

FIG. 1 is a partially enlarged front sectional view schematically illustrating an important part of a wafer-polishing head in the first embodiment of the present invention. The polishing apparatus usable with this embodiment of the present invention is similar to, for example, the conventional polishing apparatus 100 shown in FIG. 4 and has a wafer-polishing head 1 similar to the conventional wafer-polishing head 105*a* shown in FIG. 5, and so in the following description the same symbols are used as in the description of the conventional wafer-polishing head 105*a*.

A wafer-polishing head 1 shown in FIG. 1 comprises a principal head 106 having an opening portion 106*a* in the lower portion thereof, and an approximately circular shape; a flexible membrane 2 which is positioned inside the principal head 106 to close the opening portion 106*a* and for holding a wafer W at the underside of an inward peripheral portion 2*a* thereof. A sealed pressurizing chamber 107 is formed by closing the opening portion 106*a* of the principal head 106 with the flexible membrane 2. A pressure regulator (not shown in Figs.) is connected to the pressurizing chamber 107 to control the internal pressure thereof.

The flexible membrane 2 may be formed of fiber-reinforced rubber or the like and is fixed to the principal head 106 in an approximately planar state over the full face thereof by putting the outer peripheral portion 2*b* of the flexible membrane between the principal head 106 and a guide ring 110 having an approximately annular shape which is attached to the end of the opening portion of the principal head 106.

The flexible membrane 2 is thicker at its outer peripheral portion 2*b* than in its inward peripheral portion 2*a* which holds the wafer. In addition, in the present embodiment, the flexible membrane 2 has a taper at a portion in the vicinity of the outer peripheral edge of the wafer, wherein the taper is oriented so that the thickness of the flexible membrane increases towards the outer peripheral portion 2*b*.

In the wafer-polishing head 1 having a construction mentioned above, as the flexible membrane 2 is thicker in the outer peripheral portion 2*b* than in the inward peripheral portion 2*a* which holds the wafer, adequate strength can be ensured in the outer peripheral portion 2*b* which is susceptible to a load, while restricting to a low value an elastic force in the portion of the flexible membrane which holds the wafer W.

Further, as the outer peripheral portion 2*b* is thicker, the flexible membrane is hard to deform in the vicinity of the outer peripheral edge of the wafer W.

Furthermore, as a portion of the membrane in the vicinity of the outer peripheral edge of the wafer W is tapered to be thicker toward the outer peripheral portion 2*b*, the thicker portion is harder to deform, and so a force by which the wafer W is pressed against a polishing pad 104 is reduced in proportion to approaching to the outer peripheral side when the internal pressure of a pressurizing chamber 107 is raised, with the result that an amount of polishing the wafer W gently changes in the corresponding portion.

Still further, as a change of thickness is gentle in the boundary between the thin inward peripheral portion 2*a* and the thicker outer peripheral portion 2*b*, a load hardly concentrates upon one portion when a pressure is applied to the flexible membrane 2 from the pressurizing chamber 107.

As mentioned above, according to the wafer-polishing head 1 of the present embodiment and the polishing apparatus having the same, as the strength of the outer peripheral portion 2*b* which is susceptible to a load can be assured, the life of the flexible membrane 2 can be increased.

Further, an amount of polishing the wafer W gently changes in the vicinity of the edge of the outer periphery of the wafer W, thereby ensuring the polishing accuracy of the wafer W.

Furthermore, as a load hardly concentrates at one portion in the inward peripheral portion 2*a* of the flexible membrane 2, the life of the flexible membrane can be increased.

In the above-mentioned embodiment, an example is shown in which the flexible membrane is thick all over the outer peripheral portion 2*b*. However, the embodiment is not limited to the above-mentioned example. The portion having a thick membrane may be limited to that where a deformation is apt to be caused in the outer peripheral portion 2*b* or where a load is apt to concentrate (for example, a portion from the beveled part of the outer peripheral edge of the wafer W to the guide ring 110, or a boundary vicinity between a portion which is put between the principal head 106 and the guide ring 110 and a portion which is not put between the same) and any other thickness is provided to the other portions of the flexible membrane 2.

Second Embodiment

A wafer-polishing head in the second embodiment of the present invention and a polishing apparatus having the same are described in detail hereunder, referring to drawings.

Figure 2:
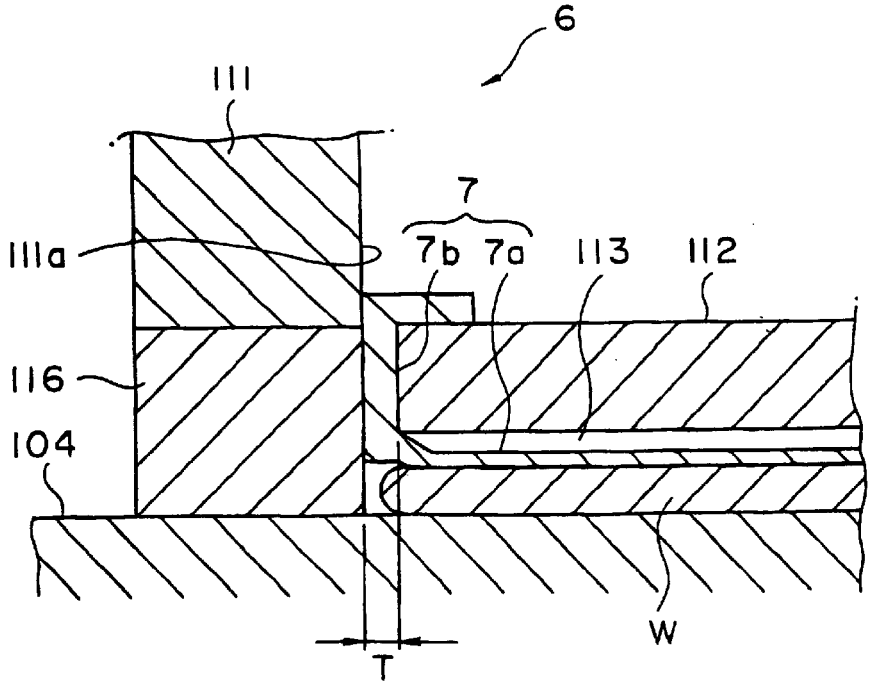
FIG. 2 is a partially enlarged front sectional view illustrating a wafer-polishing head in the second embodiment of the present invention.
Figure 6A:
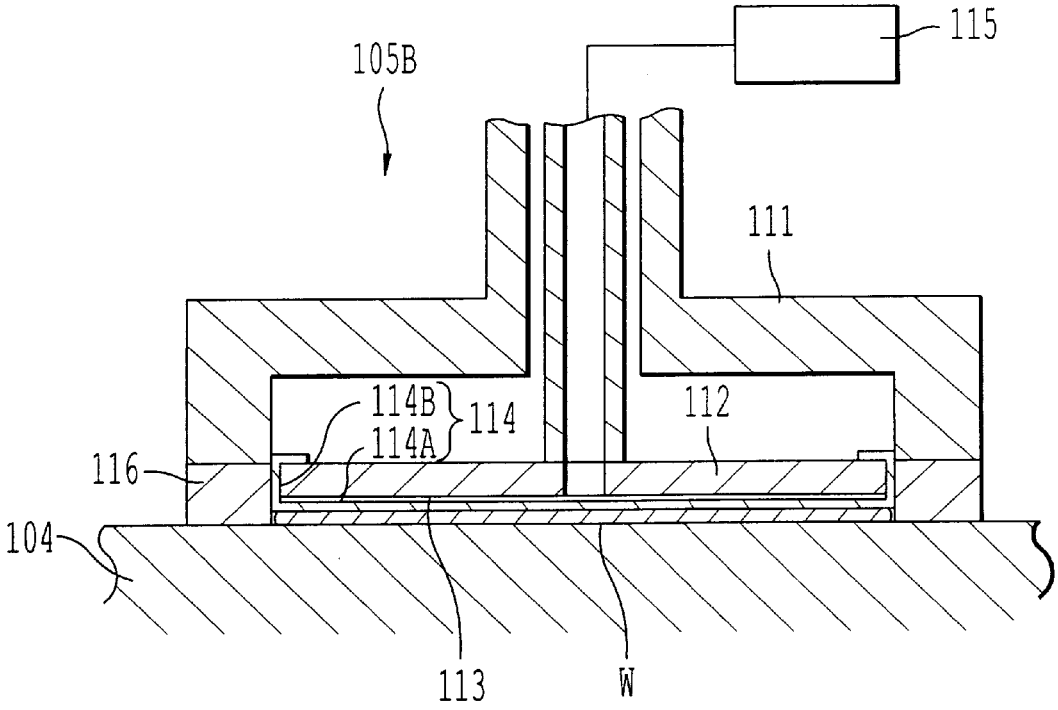
FIG. 6 is a front sectional view showing another example of a conventional wafer-polishing head.
Figure 6B:
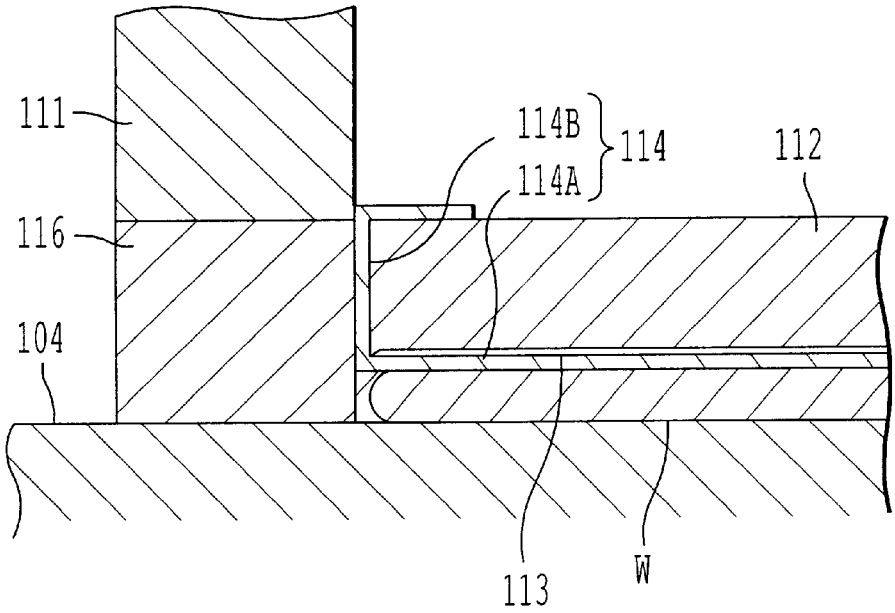
Figure 7A:
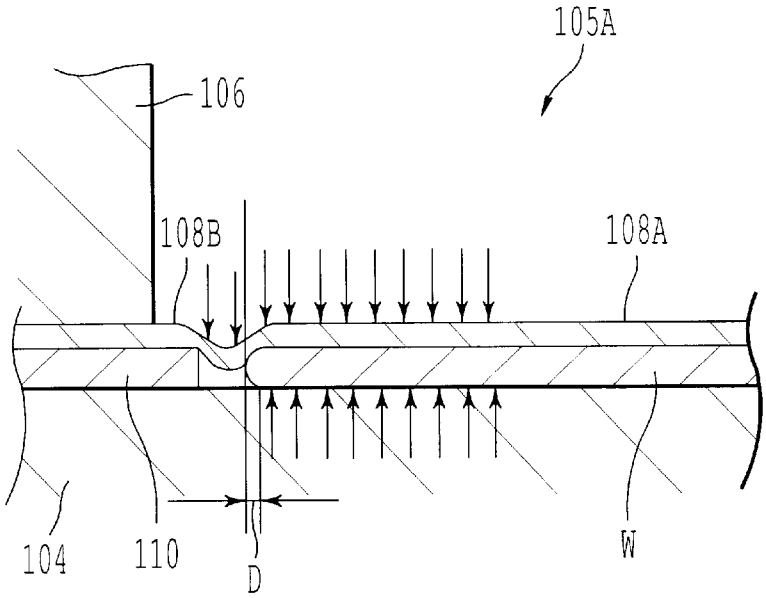
FIG. 7 is a partially enlarged front sectional view illustrating the conventional wafer-polishing head when used.
Figure 7B:
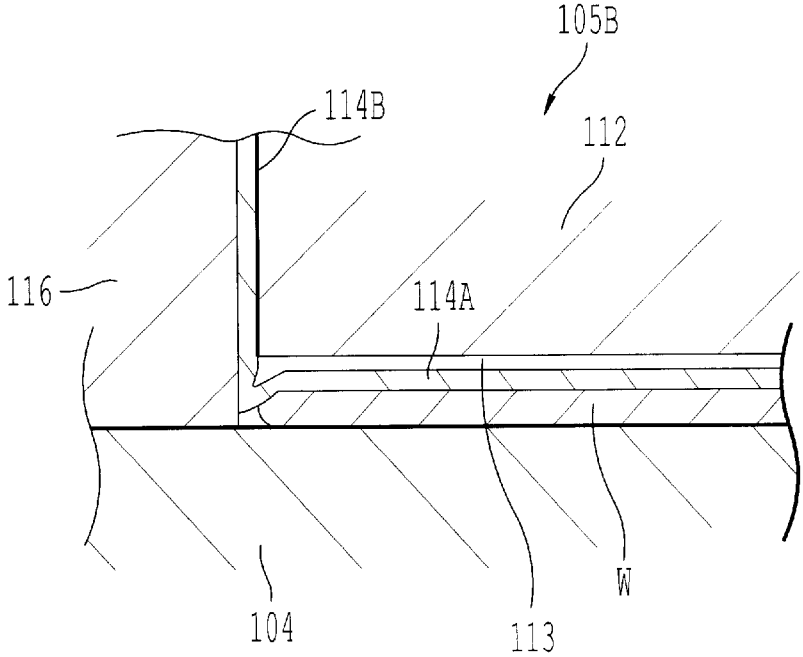

FIG. 2 is a partially enlarged front sectional view schematically illustrating an important part of a wafer-polishing head in the second embodiment of the present invention. The polishing apparatus may be similar to the conventional polishing apparatus 100 shown in FIG. 4, and the wafer-polishing head 6 may be similar to the conventional wafer-polishing head 105*b* shown in FIG. 6, and so in the following description the same symbols as in the conventional wafer-polishing head 105*b* are used for parts in the present invention.

As shown in FIG. 2, the polishing head 6 comprises a principal head 111 having a lower opening portion 111*a* and an approximately circular shape; a holding member 112 disposed inside the principal head 111; a flexible membrane 7 having an inward peripheral portion 7*a* held by the holding member 112 with an outer peripheral portion 7*b* of the membrane turned up and inward; and a sealed pressurizing chamber 113 disposed inside of the opening portion 111*a* and formed by the closing of the opening portion 111*a* with the flexible membrane 7. Here, a pressure regulator (not shown in Figs.) is connected to the pressurizing chamber 113 to control the internal pressure thereof.

Further, a retaining ring 116 having an approximately annular shape is provided in the lower end of the wafer-polishing head 6, surrounding the periphery of the opening portion 111*a*.

The flexible membrane 2 may be formed of fiber-reinforced rubber or the like. In the present invention, the flexible membrane 7 is positioned in the opening portion 111*a* of the principal head 111 with the outer peripheral portion 7*b* of the flexible membrane turned up and inward, and the outer peripheral portion 7*b* of the flexible membrane is disposed above the inward peripheral portion 7*a* thereof. The outer peripheral portion 7*b* of the flexible membrane comprises at least a portion facing the outer peripheral edge of the wafer W and another portion disposed outwardly of the portion facing the outer peripheral edge of the wafer W.

The flexible membrane is a thicker at the outer peripheral portion 7*b* than in the inward peripheral portion 7*a* which holds the wafer W. In addition, in the present embodiment, the flexible membrane is tapered to be thicker in the transition from a portion of the inward peripheral portion 7*a* which holds the vicinity of the outer peripheral edge of the wafer W towards the outer peripheral portion 7*b*.

Furthermore, in the present embodiment, a thickness T in the outer peripheral portion 7*b* of the flexible membrane 7 is the same or thicker as compared with the width of a gap which is formed between the inward peripheral face of a retaining ring 116 and the outer peripheral edge of the wafer W.

In the wafer-polishing head 6 having a construction mentioned above, the flexible membrane 7 is thicker in the outer peripheral portion 7*b* than in the inward peripheral portion 7*a* which holds the wafer, as in the first embodiment. In addition, as the flexible membrane is tapered to be thicker in a direction approaching the outer peripheral portion 7*b*, the same effect as in the wafer-polishing head 1 can be obtained in the wafer-polishing head 6.

Further, as the flexible membrane 7 is positioned in the opening portion 111*a* of the principal head 111 with the outer peripheral portion 7*b* of the flexible membrane turned up and inward, and the outer peripheral portion 7*b* of the flexible membrane is disposed above the inward peripheral portion 7*a* thereof, the flexible membrane 7 is pressed against a portion of the wafer which is limited to an area within the inward peripheral side of the wafer W excluding the outer peripheral edge of the wafer W. Thereby, the contacting area of the wafer W and the flexible membrane 7 is smaller than that of the wafer W and a polishing pad 104, with the result that a force by which the wafer W is pressed against the polishing pad 104 (polishing pressure) in the outer peripheral edge of the wafer is restrained.

Furthermore, as the thick turned up part of the membrane 7 is subject to a heavier load as compared with the other parts, the durability of the corresponding part can be increased.

According to the wafer-polishing head 6 mentioned above and the polishing apparatus having the same, as a force by which the wafer W is pressed against the polishing pad 104 (polishing pressure) is more restrained in the outer peripheral edge thereof, an amount of polishing in the outer peripheral side of the wafer W is further restrained, thereby ensuring the polishing accuracy of the wafer W.

In the second embodiment, an example is shown in which the outer peripheral side of the flexible membrane including at least a portion facing the outer peripheral edge of the wafer W is turned upwardly. However, the embodiment is not limited to the above-mentioned example. The flexible membrane 7 can be turned up at a position having approximately the same diameter as that of the outer periphery of the wafer W.

In this case, though the flexible membrane 7 is pressed against the wafer including the outer peripheral edge of the wafer W, the flexible membrane is hard to deform in such a manner that it enters around the outer peripheral edge of the wafer W, even when the internal pressure of the pressurizing chamber 113 is raised, as the corresponding portion of the flexible membrane 7 is thick.

In the above-mentioned embodiments, each of the flexible membranes 2 and 7 has a taper so as to be thick in a portion which contacts the vicinity of the outer peripheral edge of the wafer W in the outer peripheral portions 2*a* and 7*a* respectively. But other shapes can be adopted which have no taper.

Figure 3:
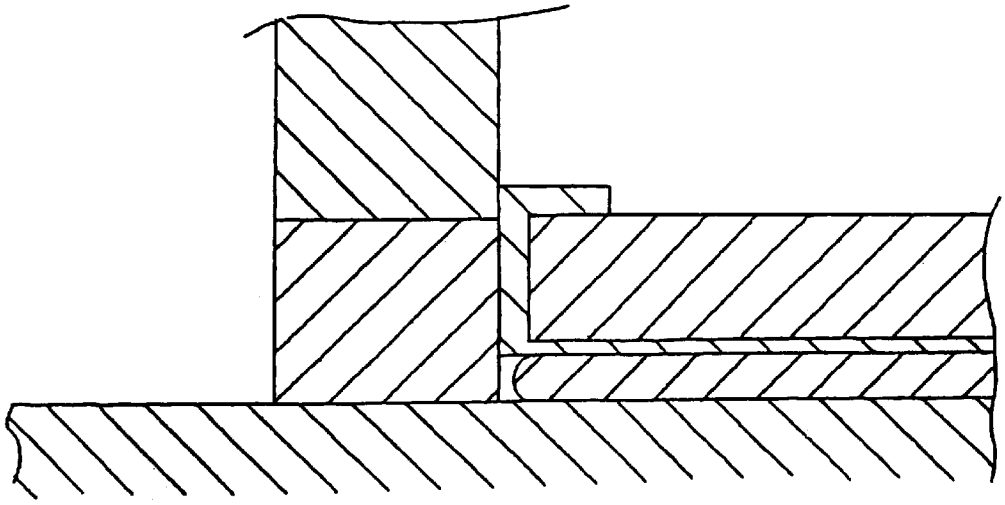
FIG. 3 is a partially enlarged front sectional view illustrating another example of a wafer-polishing head in the second embodiment of the present invention.

A case is shown in FIG. 3 of a partially enlarged front view where the flexible membrane 7 has no thickness taper, for example in the polishing head 6 shown in the second embodiment. In this case, as the flexible membrane 7 is thicker in the outer peripheral portion 7*b* thereof than in the inward peripheral portion 7*a*, and the flexible membrane 7 is thick in a portion that faces the outer peripheral edge of the wafer W, the flexible membrane is hard to deform in such a manner that it enters around the outer peripheral edge of the wafer W, even when the internal pressure of the pressurizing chamber 113 is raised.

According to the wafer-polishing head of the first aspect and the polishing apparatus having the same, the strength of the flexible membrane is assured in the outer peripheral portion which is susceptible to a load, whereby the life of the flexible membrane can be increased. Further, the flexible membrane hardly deforms in the vicinity of the outer peripheral edge of a wafer, so the life of the flexible membrane can be increased.

According to the wafer-polishing head of the second aspect and the polishing apparatus having the same, an amount of polishing a wafer changes gently in the vicinity of the outer peripheral edge of the wafer, whereby the polishing accuracy of the wafer W can be secured. Further, a load hardly concentrates at one portion in the inward peripheral portion of a flexible membrane, whereby the life of the flexible membrane can be increased.

According to the wafer-polishing head of the third aspect and the polishing apparatus having the same, as a force by which a wafer is pressed against a polishing pad (polishing pressure) can be restrained in the outer peripheral edge of the wafer, an amount of polishing of the wafer at the outer peripheral side thereof can be restrained, whereby the polishing accuracy of the wafer can be increased.

Obviously, numerous modifications and variations of the present invention are possible in light of the above teachings. It is therefore to be understood that the invention may be practiced otherwise than as specifically described herein.

What is claimed is:

1. A wafer-polishing head, comprising:

a principal head having an approximately circular lower opening portion;

a flexible membrane having an approximately circular shape which membrane is positioned in the opening portion of the principal head to close the opening portion and hold a wafer at an underside of an inward peripheral portion thereof; and a pressurizing chamber formed by the membrane closing the opening portion of the principal head, wherein the flexible membrane is thicker in an outer peripheral portion thereof than in the inward peripheral portion, and wherein the wafer is held under both the inward peripheral portion and the outer peripheral portion, and is held at least at where a deformation is apt to be caused in the outer peripheral portion or where a load is apt to concentrate in an outer peripheral edge of the wafer.

2. The wafer-polishing head as claimed in claim 1, wherein a thickness of said flexible membrane tapers in such a manner that a portion of the membrane which holds the vicinity of the outer peripheral edge of the wafer is thicker in an outward direction.

3. The wafer-polishing head as claimed in claim 2, wherein the outer peripheral portion of the flexible membrane is configured upward and inward, wherein the outer peripheral portion of the flexible membrane is disposed above the inward peripheral portion thereof, and wherein said outer peripheral portion of the flexible membrane comprises at least a portion facing the outer peripheral edge of the wafer and another portion disposed outward of the portion facing the outer peripheral edge of the wafer.

4. The wafer-polishing head as claimed in claim 1, wherein the outer peripheral portion of the flexible membrane is configured upward and inward, wherein the outer peripheral portion of the flexible membrane is disposed above the inward peripheral portion thereof, and wherein said outer peripheral portion of the flexible membrane comprises at least a portion facing the outer peripheral edge of the wafer and another portion disposed outward of the portion facing the outer peripheral edge of the wafer.

5. A wafer polishing head, comprising:

a polishing pad attached on a platen and moveably relatively to the polishing pad; and a wafer-polisher head which polishes a wafer while the wafer is pressed against the polishing pad, the wafer-polisher head comprising, a principal head having an approximately circular lower opening portion;

a flexible membrane having an approximately circular shape which membrane is positioned in the opening portion of the principal head to close the opening portion and hold a wafer at an underside of an inward peripheral portion thereof; and a pressurizing chamber formed by the membrane closing the opening portion of the principal head, wherein the flexible membrane is thicker in an outer peripheral portion thereof than in the inward peripheral portion, wherein the wafer is held under both the inward peripheral portion and the outer peripheral portion, and is held at least at where a deformation is apt to be caused in the outer peripheral portion or where a load is apt to concentrate in an outer peripheral edge of the wafer.

6. The wafer-polisher as claimed in claim 5, wherein a thickness of said flexible membrane tapers in such a manner that a portion of the membrane which holds the vicinity of the outer peripheral edge of the wafer is thicker in an outward direction.

7. The wafer-polishing as claimed in claim 6, wherein the outer peripheral portion of the flexible membrane is configured upward and inward, wherein the outer peripheral portion of the flexible membrane is disposed above the inward peripheral portion thereof, and wherein said outer peripheral portion of the flexible membrane comprises at least a portion facing the outer peripheral edge of the wafer and another portion disposed outward of the portion facing the outer peripheral edge of the wafer.

8. The wafer-polisher as claimed in claim 5, wherein the outer peripheral portion of the flexible membrane is turned up and inward wherein the outer peripheral portion of the flexible membrane is disposed above the inward peripheral portion thereof, and wherein said outer peripheral portion of the flexible membrane comprises at least a portion facing the outer peripheral edge of the wafer and another portion disposed outward of the portion facing the outer peripheral edge of the wafer.

* * * * *